US007570148B2

(12) United States Patent
Parker et al.

(10) Patent No.: US 7,570,148 B2
(45) Date of Patent: Aug. 4, 2009

(54) LOW RESISTANCE POLYMER MATRIX FUSE APPARATUS AND METHOD

(75) Inventors: Robert Parker, Bend, OR (US); Joan L. Winnett Bender, Chesterfield, MO (US); Daniel M. Manoukian, San Ramon, CA (US)

(73) Assignee: Cooper Technologies Company, Houston, TX (US)

( * ) Notice: Subject to any disclaimer, the term of this patent is extended or adjusted under 35 U.S.C. 154(b) by 19 days.

(21) Appl. No.: 10/339,114

(22) Filed: Jan. 9, 2003

(65) Prior Publication Data

US 2003/0142453 A1 Jul. 31, 2003

Related U.S. Application Data

(60) Provisional application No. 60/348,098, filed on Jan. 10, 2002.

(51) Int. Cl.
*H01H 85/044* (2006.01)
*H01H 85/046* (2006.01)

(52) U.S. Cl. ..... 337/297; 337/227; 337/228; 337/232

(58) Field of Classification Search ..... 337/297, 337/232, 227, 228; 29/623
See application file for complete search history.

(56) References Cited

U.S. PATENT DOCUMENTS 3,500,276 A * 3/1970 Hingorany et al. ..... 337/183
3,585,556 A * 6/1971 Hingorany et al. ..... 337/297
3,715,698 A * 2/1973 Blewitt ..... 337/166
4,296,398 A * 10/1981 McGalliard ..... 337/297
4,612,529 A * 9/1986 Gurevich et al. ..... 337/255
4,763,228 A * 8/1988 Su ..... 361/534
4,814,946 A * 3/1989 Su ..... 361/523
4,924,203 A * 5/1990 Gurevich ..... 337/231
4,988,969 A * 1/1991 Gurevich ..... 337/260
5,130,688 A 7/1992 Van Rietschoten et al.
5,153,553 A * 10/1992 Ruehl et al. ..... 337/273
5,166,656 A 11/1992 Badihi et al.
5,196,819 A * 3/1993 Roberts ..... 337/297
5,227,759 A * 7/1993 Hatagishi ..... 337/260
5,228,188 A * 7/1993 Badihi et al. ..... 29/623
5,294,905 A * 3/1994 Pimpis ..... 337/158
5,296,832 A * 3/1994 Perreault et al. ..... 337/158
5,296,833 A * 3/1994 Breen et al. ..... 337/297
5,309,625 A * 5/1994 Onishi ..... 29/623
5,426,411 A * 6/1995 Pimpis et al. ..... 337/186
5,432,378 A * 7/1995 Whitney et al. ..... 257/529

(Continued)

FOREIGN PATENT DOCUMENTS

JP 04-275018 4/1994

(Continued)

OTHER PUBLICATIONS

European Patent Office, Communication, May 4, 2004.

*Primary Examiner*—Anatoly Vortman
(74) *Attorney, Agent, or Firm*—Armstrong Teasdale LLP

(57) ABSTRACT

A low resistance fuse includes a fuse element layer, and first and second intermediate insulation layers extending on opposite sides of the fuse element layer and coupled thereto. The fuse element layer is formed on the first intermediate insulation layer and the second insulation layer is laminated to the fuse element layer.

19 Claims, 8 Drawing Sheets

U.S. PATENT DOCUMENTS

| | | | | | |
|---|---|---|---|---|---|
| 5,552,757 | A | | 9/1996 | Blecha et al. | |
| 5,606,301 | A | | 2/1997 | Ishimura | |
| 5,621,375 | A | * | 4/1997 | Gurevich | 337/297 |
| 5,699,032 | A | * | 12/1997 | Ulm et al. | 337/297 |
| 5,712,610 | A | * | 1/1998 | Takeichi et al. | 337/290 |
| 5,726,621 | A | * | 3/1998 | Whitney et al. | 337/297 |
| 5,790,008 | A | | 8/1998 | Blecha et al. | |
| 5,821,849 | A | * | 10/1998 | Dietsch et al. | 337/241 |
| 5,844,477 | A | | 12/1998 | Blecha et al. | |
| 5,886,613 | A | * | 3/1999 | Magoon et al. | 337/244 |
| 5,914,649 | A | | 6/1999 | Isono et al. | |
| 5,923,239 | A | | 7/1999 | Krueger et al. | |
| 5,929,741 | A | | 7/1999 | Nishimura et al. | |
| 5,943,764 | A | | 8/1999 | Blecha et al. | |
| 5,977,860 | A | * | 11/1999 | Ulm et al. | 337/297 |
| 6,002,322 | A | | 12/1999 | Krueger et al. | |
| 6,043,966 | A | | 3/2000 | Krueger et al. | |
| 6,078,245 | A | | 6/2000 | Fritz et al. | |
| 2003/0048620 | A1 | | 3/2003 | Nishimura et al. | |

FOREIGN PATENT DOCUMENTS

| | | | |
|---|---|---|---|
| JP | 07-182600 | | 2/1997 |
| JP | 10269927 | A | 10/1998 |
| JP | 2000331590 | A | 11/2000 |
| WO | WO 01/69988 | | 9/2001 |

* cited by examiner

LOW RESISTANCE POLYMER MATRIX FUSE APPARATUS AND METHOD

CROSS REFERENCE TO RELATED APPLICATIONS

This application claims the benefit of U.S. Provisional Application Ser. No. 60/348,098 filed Jan. 10, 2002.

BACKGROUND OF THE INVENTION

This invention relates generally to fuses, and, more particularly, to fuses employing foil fuse elements.

Fuses are widely used as overcurrent protection devices to prevent costly damage to electrical circuits. Typically, fuse terminals or contacts form an electrical connection between an electrical power source and an electrical component or a combination of components arranged in an electrical circuit. One or more fusible links or elements, or a fuse element assembly, is connected between the fuse terminals or contacts, so that when electrical current through the fuse exceeds a predetermined threshold, the fusible elements melt, disintegrate, sever, or otherwise open the circuit associated with the fuse to prevent electrical component damage.

A proliferation of electronic devices in recent times has resulted in increased demands on fusing technology. For example, a conventional fuse includes a wire fuse element (or alternatively a stamped and/or shaped metal fuse element) encased in a glass cylinder or tube and suspended in air within the tube. The fuse element extends between conductive end caps attached to the tube for connection to an electrical circuit. However, when used with printed circuit boards in electronic applications, the fuses typically must be quite small, leading to manufacturing and installation difficulties for these types of fuses that increase manufacturing and assembly costs of the fused product.

Other types of fuses include a deposited metallization on a high temperature organic dielectric substrate (e.g. FR-4, phenolic or other polymer-based material) to form a fuse element for electronic applications. The fuse element may be vapor deposited, screen printed, electroplated or applied to the substrate using known techniques, and fuse element geometry may be varied by chemically etching or laser trimming the metallized layer forming the fuse element. However, during an overcurrent condition, these types of fuses tend to conduct heat from the fuse element into the substrate, thereby increasing a current rating of the fuse but also increasing electrical resistance of the fuse, which may undesirably affect low voltage electronic circuits. In addition, carbon tracking may occur when the fuse element is in close proximity to or is deposited directly on a dielectric substrate. Carbon tracking will not allow the fuse to fully clear or open the circuit as the fuse was intended.

Still other fuses employ a ceramic substrate with a printed thick film conductive material, such as a conductive ink, forming a shaped fuse element and conductive pads for connection to an electrical circuit. However, inability to control printing thickness and geometry can lead to unacceptable variation in fused devices. Also, the conductive material that forms the fuse element typically is fired at high temperatures so a high temperature ceramic substrate must be used. These substrates, however, tend to function as a heat sink in an overcurrent condition, drawing heat away from the fuse element and increasing electrical resistance of the fuse.

In many circuits high fuse resistance is detrimental to the functioning of active circuit components, and in certain applications voltage effects due to fuse resistance may render active circuit components inoperable.

BRIEF DESCRIPTION OF THE INVENTION

In one aspect, a low resistance fuse is provided. The fuse comprises a fuse element layer, and first and second intermediate insulation layers extending on opposite sides of said fuse element layer and coupled thereto, said fuse element layer formed on said first intermediate insulation layer and said second insulation layer laminated to said fuse element layer.

In another aspect, a method of fabricating a low resistance fuse is provided. The method comprises providing a first intermediate insulating layer, metallizing the first intermediate insulating layer with a fuse element layer, forming a fusible link extending between first and second contact pads from the fuse element layer, and coupling a second intermediate insulation layer to the first intermediate insulating layer over the fuse element layer.

In another aspect, a low resistance fuse is provided. The fuse comprises a thin foil fuse element layer. The first and second intermediate insulation layers extend on opposite sides of said fuse element layer and are coupled thereto, and the fuse element layer is formed on said first intermediate insulation layer. The second insulation layer is laminated to said fuse element layer, a first outer insulating layer is laminated to said first intermediate insulating layer, and a second outer insulating layer is laminated to said second intermediate insulating layer.

In another aspect, a low resistance fuse is provided. The fuse comprises a thin foil fuse element layer comprising first and second contact pads and a fusible link extending between said first and second contact pads. First and second intermediate insulation layers extend on opposite sides of said fuse element layer, and at least one of said first and second intermediate insulation layers comprises an opening therethrough in the vicinity of said fusible link. A first outer insulating layer extends over said first intermediate insulating layer a second outer insulating layer extends over said second intermediate insulating layer, and at least one of said first and second outer insulating layer encloses said opening of at least one of said first and second intermediate insulation layers.

In still another aspect, a low resistance fuse is provided. The fuse comprises a thin foil fuse element layer comprising a 1 micron to 20 micron electro deposited metal foil formed into first and second contact pads and a fusible link extending between said first and second contact pads. First and second intermediate insulation layers extend on opposite sides of said fuse element layer, and each of said first and second intermediate insulation layers comprise an opening therethrough in the vicinity of said fusible link. At least one of said first and second intermediate insulation layers comprises a polyimide material, a first outer insulating layer extends over said first intermediate insulating layer, and a second outer insulating layer extends over said second intermediate insulating layer. Each of said first and second outer insulating layer encloses said opening of at least one of said first and second intermediate insulation layers, and at least one of said first and second outer insulating layer comprises a polyimide material.

DETAILED DESCRIPTION OF THE INVENTION

Figure 1:
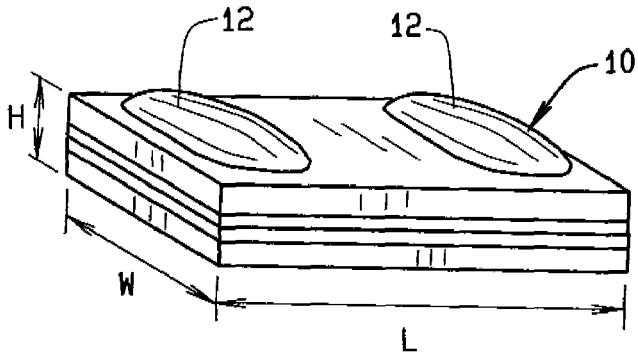
FIG. 1 is a perspective view of a foil fuse.

FIG. 1 is a perspective view of a foil fuse 10 in accordance with an exemplary embodiment of the present invention. For the reasons set forth below, fuse 10 is believed to be manufacturable at a lower cost than conventional fuses while providing notable performance advantages. For example, fuse 10 is believed to have a reduced resistance in relation to known comparable fuses and increased insulation resistance after the fuse has operated. These advantages are achieved at least in part through the use of thin metal foil materials for formation of a fusible link and contact terminations mounted onto polymer films. For descriptive purposes herein, thin metal foil materials are deemed to range in thickness from about 1 to about 100 microns, more specifically from about 1 to about 20 microns, and in a particular embodiment from about 3 to about 12 microns.

While at least one fuse according to the present invention has been found particularly advantageous when fabricated with thin metal foil materials, it is contemplated that other metallization techniques may also be beneficial. For example, for lower fuse ratings that require less than 3 to 5 microns of metallization to form the fuse element, thin film materials may be used according to techniques known in the art, including but not limited to sputtered metal films. It is further appreciated that aspects of the present invention may also apply to electroless metal plating constructions and to thick film screen printed constructions. Fuse 10 is therefore described for illustrative purposes only, and the description of fuse 10 herein is not intended to limit aspects of the invention to the particulars of fuse 10.

Fuse 10 is of a layered construction, described in detail below, and includes a foil fuse element (not shown in FIG. 1) electrically extending between and in a conductive relationship with solder contacts 12 (sometimes referred to as solder bumps). Solder contacts 12, in use, are coupled to terminals, contact pads, or circuit terminations of a printed circuit board (not shown) to establish an electrical circuit through fuse 10, or more specifically through the fuse element. When current flowing through fuse 10 reaches unacceptable limits, dependant upon characteristics of the fuse element and particular materials employed in manufacture of fuse 10, the fuse element melts, vaporizes, or otherwise opens the electrical circuit through the fuse and prevents costly damage to electrical components in the circuit associated with fuse 10.

In an illustrative embodiment, fuse 10 is generally rectangular in shape and includes a width W, a length L and a height H suitable for surface mounting of fuse 10 to a printed circuit board while occupying a small space. For example, in one particular embodiment, L is approximately 0.060 inches and W is approximately 0.030 inches, and H is considerably less than either L or W to maintain a low profile of fuse 10. As will become evident below, H is approximately equal to the combined thickness of the various layers employed to fabricate fuse 10. It is recognized, however, that actual dimensions of fuse 10 may vary from the illustrative dimensions set forth herein to greater or lesser dimensions, including dimensions of more than one inch without departing from the scope of the present invention.

It is also recognized that at least some of the benefits of the present invention may be achieved by employing other fuse terminations than the illustrated solder contacts 12 for connecting fuse 10 to an electrical circuit. Thus, for example, contact leads (i.e. wire terminations), wrap-around terminations, dipped metallization terminations, plated terminations, castellated contacts, and other known connection schemes may be employed as an alternative to solder contacts 12 as needs dictate or as desired.

Figure 2:
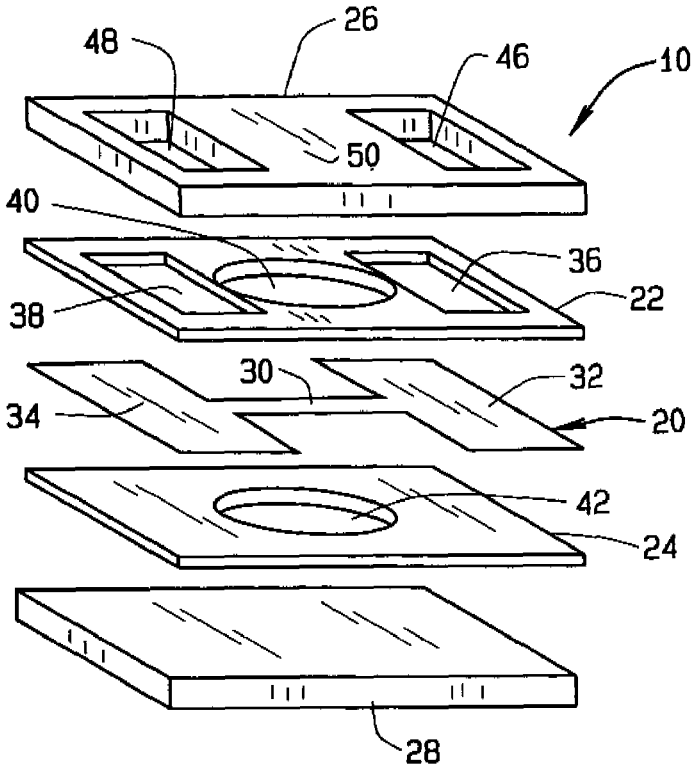
FIG. 2 is an exploded perspective view of the fuse shown in FIG. 1.

FIG. 2 is an exploded perspective view of fuse 10 illustrating the various layers employed in fabrication of fuse 10. Specifically, in an exemplary embodiment, fuse 10 is constructed essentially from five layers including a foil fuse element layer 20 sandwiched between upper and lower intermediate insulating layers 22, 24 which, in turn, are sandwiched between upper and lower outer insulation layers 26, 28.

Foil fuse element layer 20, in one embodiment, is an electro deposited, 3-5 micron thick copper foil applied to lower intermediate layer 24 according to known techniques. In an exemplary embodiment, the foil is a CopperBond® Extra Thin Foil available from Olin, Inc., and thin fuse element layer 20 is formed in the shape of a capital I with a narrowed fusible link 30 extending between rectangular contact pads 32, 34. Fusible link 30 is dimensioned to open when current flowing through fusible link 30 reaches a specified level. For example, in an exemplary embodiment, fusible link 30 is about 0.003 inches wide so that the fuse operates at less than 1 ampere. It is understood, however, that in alternative embodiments various dimensions of the fusible link may be employed and that thin fuse element layer 20 may be formed from other metal foils, including but not limited to nickel, zinc, tin, aluminum, silver, alloys thereof (e.g., copper/tin, silver/tin, and copper/silver alloys) and other conductive foil materials in lieu of a copper foil. In alternative embodiments, 9 micron or 12 micron thickness foil materials may be employed and chemically etched to reduce the thickness of the fusible link. Additionally, a known M-effect fusing technique may be employed in further embodiments to enhance operation of the fusible link.

As appreciated by those in the art, performance of the fusible link (e.g. short circuit and interrupting capability) is dependant upon and primarily determined by the melting temperature of the materials used and the geometry of the fusible link, and through variation of each a virtually unlimited number of fusible links having different performance characteristics may be obtained. In addition, more than one fusible link may extend in parallel to further vary fuse performance. In such an embodiment, multiple fusible links may extend in parallel between contact pads in a single fuse element layer or multiple fuse element layers may be employed including fusible links extending parallel to one another in a vertically stacked configuration.

To select materials to produce a fuse element layer 20 having a desired fuse element rating, or to determine a fuse element rating fabricated from selected materials, it has been determined that fusing performance is primarily dependant upon three parameters, including fuse element geometry, thermal conductivity of the materials surrounding the fuse element, and a melting temperature of the fusing metal. It has been determined that each of these parameters determine the time versus current characteristics of the fuse. Thus, through careful selection of materials for the fuse element layer, materials surrounding the fuse element layer, and geometry of the fuse element layer, acceptable low resistance fuses may be produced.

Considering first the geometry of fuse element 20, for purposes of illustration the characteristics of an exemplary fuse element layer will be analyzed. For example, FIG. 6 illustrates a plan view of a relatively simple fuse element geometry including exemplary dimensions.

Figure 6:
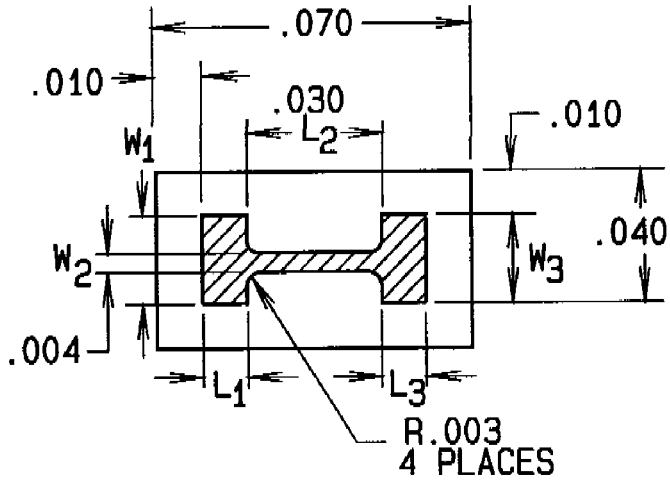
FIGS. 6-10 are top plan views of fuse element geometries for the fuses shown in FIGS. 1-5.
Figure 7:
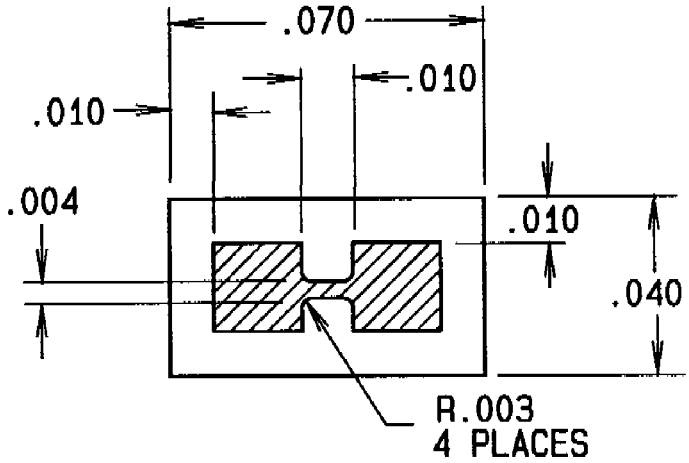
Figure 8:
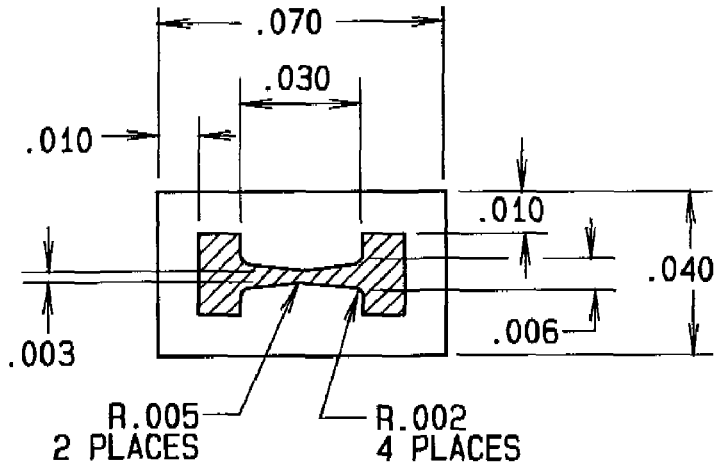
Figure 9:
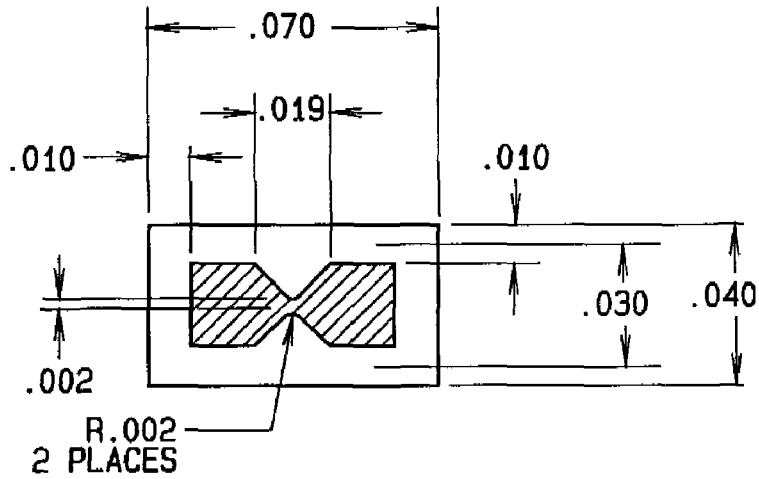
Figure 10:
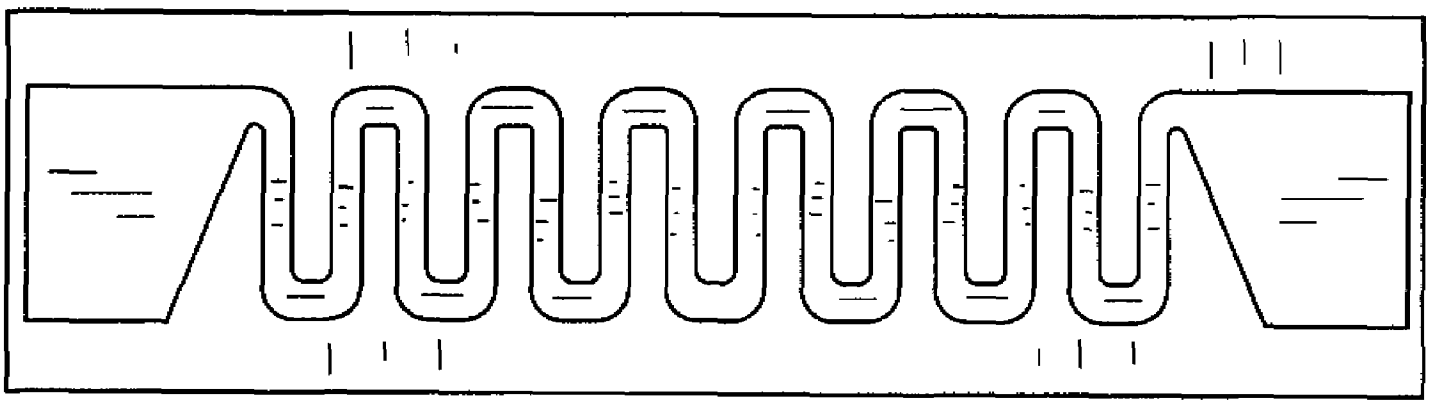

Referring to FIG. 6, a fuse element layer in the general shape of a capital I is formed on an insulating layer. Fusing characteristics of the fuse element layer are goverened by the electrical conductivity (ρ) of the metal used to form fuse element layer, dimensional aspects of the fuse element layer (i.e., length and width of fuse element) and the thickness of the fuse element layer. In an illustrative embodiment, the fuse element layer 20 is formed from a 3 micron thick copper foil, which is known to have a sheet resistance (measured for a 1 micron thickness) of 1/ρ*cm or about 0.016779Ω/□ where □ is a dimensional ratio of the fuse element portion under consideration expressed in "squares."

For example, considering the fuse element shown in FIG. 6, the fuse element includes three distinct segments identifiable with dimensions $l_1$ and $w_1$ corresponding to the first segment, $l_2$ and $w_2$ corresponding to the second segment and $l_3$ and $w_3$ corresponding to the third segment. By summing the squares in the segments the resistance of the fuse element layer may be approximately determined in a rather direct manner. Thus, for the fuse element shown in FIG. 6:

$$\begin{aligned}\text{Number of squares} &= (l_1/w_1 + l_2/w_2 + l_3/w_3) \\ &= (10/20 + 30/4 + 10/20) \\ &= 8.5\square\text{'s.}\end{aligned} \tag{1}$$

Now the electrical resistance (R) of the fuse element layer may be determined according to the following relationship:

$$\text{Fuse Element } R = (\text{Sheet Resistivity})*(\text{Number }\square\text{'s})/T \tag{2}$$

where T is a thickness of the fuse element layer. Continuing with the foregoing example and applying Equation (2), it may be seen that:

$$\text{Fuse Element Resistance} = (0.016779\Omega/\square)*(8.5\square)/3 = 0.0475\Omega.$$

Of course, a fuse element resistance of a more complicated geometry could be likewise determined in a similar fashion.

Considering now the thermal conductivity of materials surrounding the fuse element layer, those in the art may appreciate that heat flow (H) between subvolumes of dissimilar material is governed by the relationship:

$$\Delta h_{(m,n)\text{ to }(m+1,n)} = \frac{2(\theta_{m,n} - \theta) * Y_n * Z * K_{m,n} * \Delta t}{X_{m,n}} \tag{3}$$

where $K_{m,n}$ is a thermal conductivity of a first subvolume of material; $K_{m+1,n}$ is a thermal conductivity of second subvolume of material; Z is a thickness of the material at issue; θ is the temperature of subvolume m,n at a selected reference point; $X_{m,n}$ is a first coordinate location of the first subvolume measure from the reference point, and $Y_n$ is a second coordinate location measure from the reference point, and Δt is a time value of interest.

While Equation (3) may be studied in great detail to determine precise heat flow characteristics of a layered fuse construction, it is presented herein primarily to show that heat flow within the fuse is proportional to the thermal conductivity of the materials used. Thermal conductivity of some exemplary known materials are set forth in the following Table, and it may be seen that by reducing the conductivity of the insulating layers employed in the fuse around the fuse element, heat flow within the fuse may be considerably reduced. Of particular note is the significantly lower thermal conductivity of polyimide, which is employed in illustrative embodiments of the invention as insulating material above and below the fuse element layer.

| Substrate Thermal Conductivity's (W/mK) | |
|---|---|
| Alumina ($Al_2O_3$) | 19 |
| Forsterite ($2MgO—SiO_2$) | 7 |
| Cordierite ($2MgO—2Al_2O_3—5SiO_2$) | 1.3 |
| Steatite ($2MgO—SiO_2$) | 3 |
| Polyimide | 0.12 |
| FR-4 Epoxy Resin/Fiberglass Laminate | 0.293 |

Now considering the operating temperature of the fusing metal employed in fabrication of the fuse element layer, those in the art may appreciate that the operating temperature $\theta_t$ of the fuse element layer at a given point in time is governed by the following relationship:

$$\theta_t = (1/m*s)*\int i^2 R_{am}(1+\alpha\theta)dt \tag{4}$$

where m is the mass of the fuse element layer, s is the specific heat of the material forming the fuse element layer, $R_{am}$ is the resistance of the fuse element layer at an ambient reference temperature θ, i is a current flowing through the fuse element layer, and α is a resistance temperature coefficient for the fuse element material. Of course, the fuse element layer is functional to complete a circuit through the fuse up to the melting temperature of the fuse element material. Exemplary melting points of commonly used fuse element materials are set forth in the table below, and is noted that copper fuse element layers are especially advantageous in the present invention due to the significantly higher melting temperature of copper which permits higher current rating of the fuse element.

| Metal and Metal Alloy Melt Temperatures (° C.) | |
|---|---|
| Copper (Cu) | 1084 |
| Zinc (Zn) | 419 |
| Aluminum (Al) | 660 |
| Copper/Tin (20Cu/80Sn) | 530 |
| Silver/Tin (40Ag/60Sn) | 450 |
| Copper/Silver (30Cu/70Ag) | 788 |

It should now be evident that consideration of the combined effects of melting temperature of materials for the fuse element layer, thermal conductivity of materials surrounding the fuse element layer, and the resistivity of the of the fuse element layer, acceptable low resistance fuses may be produced having a variety of performance characteristics.

Referring back to FIG. 2, upper intermediate insulating layer 22 overlies foil fuse element layer 20 and includes rectangular termination openings 36, 38 or windows extending therethrough to facilitate electrical connection to respective contact pads 32, 34 of foil fuse element layer 20. A circular shaped fusible link opening 40 extends between termination openings 36, 38 and overlies fusible link 30 of foil fuse element layer 20.

Lower intermediate insulating layer 24 underlies foil fuse element layer 20 and includes a circular shaped fuse link opening 42 underlying fusible link 30 of foil fuse element layer 20. As such, fusible link 30 extends across respective fuse link openings 40, 42 in upper and lower intermediate insulating layers 22, 24 such that fusible link 30 contacts a surface of neither intermediate insulating layer 22, 24 as fusible link 30 extends between contact pads 32, 34 of foil fuse element 20. In other words, when fuse 10 is fully fabricated, fusible link 30 is effectively suspended in an air pocket by virtue of fuse link openings 40, 42 in respective intermediate insulating layers 22, 24.

As such, fuse link openings 40, 42 prevent heat transfer to intermediate insulating layers 22, 24 that in conventional fuses contributes to increased electrical resistance of the fuse. Fuse 10 therefore operates at a lower resistance than known fuses and consequently is less of a circuit perturbation than known comparable fuses. In addition, and unlike known fuses, the air pocket created by fusible link openings 40, 42 inhibits arc tracking and facilitates complete clearing of the circuit through fusible link 30. In a further embodiment, a properly shaped air pocket may facilitate venting of gases therein when the fusible link operates and alleviate undesirable gas buildup and pressure internal to the fuse. Thus, while openings 40, 42 are illustrated as substantially circular in an exemplary embodiment, non-circular openings 40, 42 may likewise be employed without departing from the scope and spirit of the present invention. Additionally, it is contemplated that asymmetrical openings may be employed as fuse link openings in intermediate insulating layers 22, 24. Still further, it is contemplated that the fuse link openings, however, may be filled with a solid or gas to inhibit arc tracking in lieu of or in addition to air as described above.

In an illustrative embodiment, upper and lower intermediate insulation layers are each fabricated from a dielectric film, such as a 0.002 inch thick polyimide commercially available and sold under the trademark KAPTON® from E. I. du Pont de Nemours and Company of Wilmington, Del. It is appreciated, however, that in alternative embodiments, other suitable electrical insulation materials (polyimide and non-polyimide) such as CIRLEX® adhesiveless polyimide lamination materials, UPILEX® polyimide materials commercially available from Ube Industries, Pyrolux, polyethylene naphthalendicarboxylate (sometimes referred to as PEN), Zyvrex liquid crystal polymer material commercially available from Rogers Corporation, and the like may be employed in lieu of KAPTON®.

Upper outer insulation layer 26 overlies upper intermediate layer 22 and includes rectangular termination openings 46, 48 substantially coinciding with termination openings 36, 38 of upper intermediate insulation layer 22. Together, termination openings 46, 48 in upper outer insulating layer 26 and termination openings 36, 38 in upper intermediate insulating layer 22 form respective cavities above thin fuse element contact pads 32, 34. When openings 36, 38, 46, 48 are filled with solder (not shown in FIG. 2), solder contact pads 12 (shown in FIG. 1) are formed in a conductive relationship to fuse element contact pads 32, 34 for connection to an external circuit on, for example, a printed circuit board. A continuous surface 50 extends between termination openings 46, 48 of upper outer insulating layer 26 that overlies fusible link opening 40 of upper intermediate insulating layer 22, thereby enclosing and adequately insulating fusible link 30.

In a further embodiment, upper outer insulation layer 26 and/or lower outer insulation layer 28 is fabricated from translucent or transparent materials that facilitate visual indication of an opened fuse within fusible link openings 40, 42.

Lower outer insulating layer 28 underlies lower intermediate insulating layer 24 and is solid, i.e., has no openings. The continuous solid surface of lower outer insulating layer 28 therefore adequately insulates fusible link 30 above fusible link opening 42 of lower intermediate insulating layer 24.

In an illustrative embodiment, upper and lower outer insulation layers are each fabricated from a dielectric film, such as a 0.005 inch thick polyimide film commercially available and sold under the mark KAPTON® from E. I. du Pont de Nemours and Company of Wilmington, Del. It is appreciated, however, that in alternative embodiments, other suitable electrical insulation materials such as CIRLEX® adhesiveless polyimide lamination materials, Pyrolux, polyethylene naphthalendicarboxylate and the like may be employed.

For purposes of describing an exemplary manufacturing process employed to fabricate fuse 10, the layers of fuse 10 are referred to according to the following table:

| Process Layer | FIG. 2 Layer | FIG. 2 Reference |
|---|---|---|
| 1 | Upper Outer Insulating Layer | 26 |
| 2 | Upper Intermediate Insulation Layer | 22 |
| 3 | Foil Fuse Element Layer | 20 |
| 4 | Lower Intermediate Insulating Layer | 24 |
| 5 | Lower Outer Insulating Layer | 28 |

Figure 3:
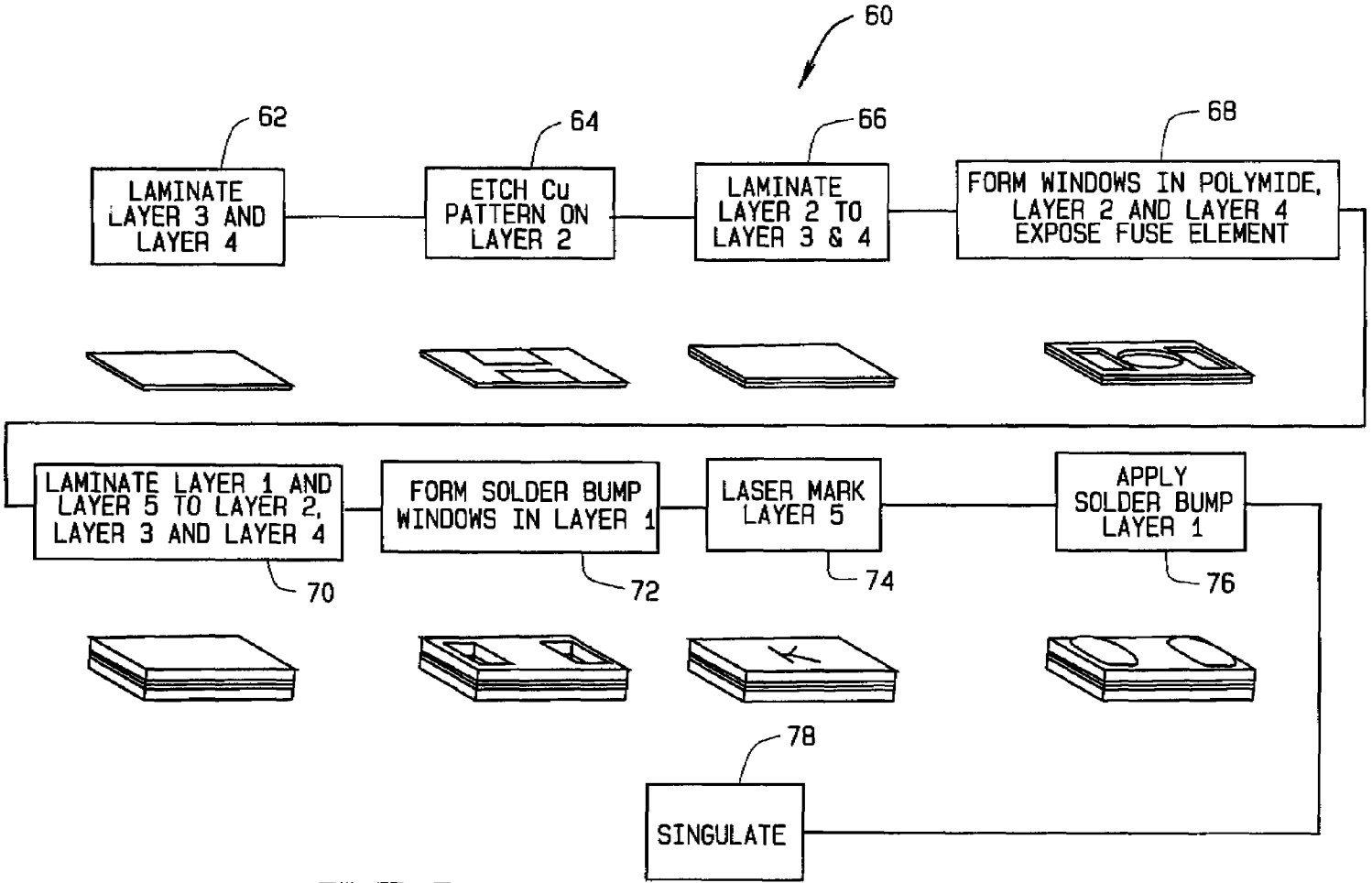
FIG. 3 is a process flow chart of a method of manufacturing the fuse shown in FIGS. 1 and 2.

Using these designations, FIG. 3 is a flow chart of an exemplary method 60 of manufacturing fuse 10 (shown in FIGS. 1 and 2). Foil fuse element layer 20 (layer 3) is laminated 62 to lower intermediate layer 24 (layer 4) according to known lamination techniques. Foil fuse element layer 20 (layer 3) is then etched 64 away into a desired shape upon lower intermediate insulating layer 24 (layer 4 ) using known techniques, including but not limited to use of a ferric chloride solution. In an exemplary embodiment, foil fuse element layer 20 (layer 3) is formed such that the capital I shaped foil fuse element remains as described above in relation to FIG. 2 according to a known etching process. In alternative embodiments, die cutting operations may be employed in lieu of etching operations to form the fusible link 30 and contact pads 32, 34.

After forming 64 foil fuse element layer (layer 3) from lower intermediate insulating layer (layer 4) has been completed, upper intermediate insulating layer 22 (layer 2) is laminated 66 to pre-laminated foil fuse element layer 20 (layer 3) and lower intermediate insulating layer (layer 4) from step 62, according to known lamination techniques. A three layer lamination is thereby formed with foil fuse element layer 20 (layer 3) sandwiched between intermediate insulating layers 22, 24 (layers 2 and 4).

Termination openings 36, 38 and fusible link opening 40 (all shown in FIG. 2) are then formed 68 in upper intermediate insulating layer 22 (layer 2) according to a known etching, punching, or drilling process. Fusible link opening 42 (shown in FIG. 2) is also formed 68 in lower intermediate insulating layer 28 according to a known process, including but not limited to etching, punching and drilling. Fuse element layer contact pads 32, 34 (shown in FIG. 2) are therefore exposed through termination openings 36, 38 in upper intermediate insulating layer 22 (layer 2). Fusible link 30 (shown in FIG. 2) is exposed within fusible link openings 40, 42 of respective intermediate insulating layers 22, 24 (layers 2 and 4). In alternative embodiments, die cutting operations, drilling and punching operations, and the like may be employed in lieu of etching operations to form the fusible link opening 40 and termination openings 36, 38.

After forming 68 the openings or windows into intermediate insulation layers 22, 24 (layers 2 and 4), outer insulating layers 26, 28 (layers 1 and 5) are laminated 70 to the three layer combination (layers 2, 3, and 4) from steps 66 and 68. Outer insulation layers 26, 28 (layers 1 and 5) are laminated to the three layer combination using processes and techniques known in the art.

After outer insulation layers 26, 28 (layers 1 and 5) are laminated 70 to form a five layer combination, termination openings 46, 48 (shown in FIG. 2) are formed 72, according to known methods and techniques into upper outer insulating layer 26 (layer 1) such that fuse element contact pads 32, 34 (shown in FIG. 2) are exposed through upper outer insulation layer 26 (layer 1) and upper intermediate insulation layer 22 (layer 2) through respective termination openings 36, 38, and 46, 48. Lower outer insulating layer 28 (layer 5) is then marked 74 with indicia pertaining to operating characteristics of fuse 10 (shown in FIGS. 1 and 2), such as voltage or current ratings, a fuse classification code, etc. Marking 74 may be performed according to known processes, such as, for example, laser marking, chemical etching or plasma etching. It is appreciated that other known conductive contact pads, including but not limited to Nickel/Gold, Nickel/Tin, Nickel/Tin-Lead and Tin plated pads, may be employed in alternative embodiments in lieu of solder contacts 12.

Solder is then applied 76 to complete solder contacts 12 (shown in FIG. 1) in conductive communication with fuse element contact pads 32, 34 (shown in FIG. 2). Therefore, an electrical connection may be established through fusible link 30 (shown in FIG. 2) when solder contacts 12 are coupled to line and load electrical connections of an energized circuit.

While fuses 10 could be manufactured singly according to the method thus far described, in an illustrative embodiment, fuses 10 are fabricated collectively in sheet form and then separated or singulated 78 into individual fuses 10. When formed in a batch process, various shapes and dimensions of fusible links 30 may be formed at the same time with precision control of etching and die cutting processes. In addition, roll to roll lamination processes may be employed in a continuous fabrication process to manufacture a large number of fuses with minimal time.

Further, fuses including additional layers may be fabricated without departing from the basic methodology described above. Thus, multiple fuse element layers may be utilized and/or additional insulating layers to fabricate fuses with different performance characteristics and various package sizes.

Fuses may therefore be efficiently formed using low cost, widely available materials in a batch process using inexpensive known techniques and processes. Photochemical etching processes allow rather precise formation of fusible link 30 and contact pads 32, 34 of thin fuse element layer 20, even for very small fuses, with uniform thickness and conductivity to minimize variation in final performance of fuses 10. Moreover, the use of thin metal foil materials to form fuse element layer 20 renders it possible to construct fuses of very low resistance in relation to known comparable fuses.

Figure 4:
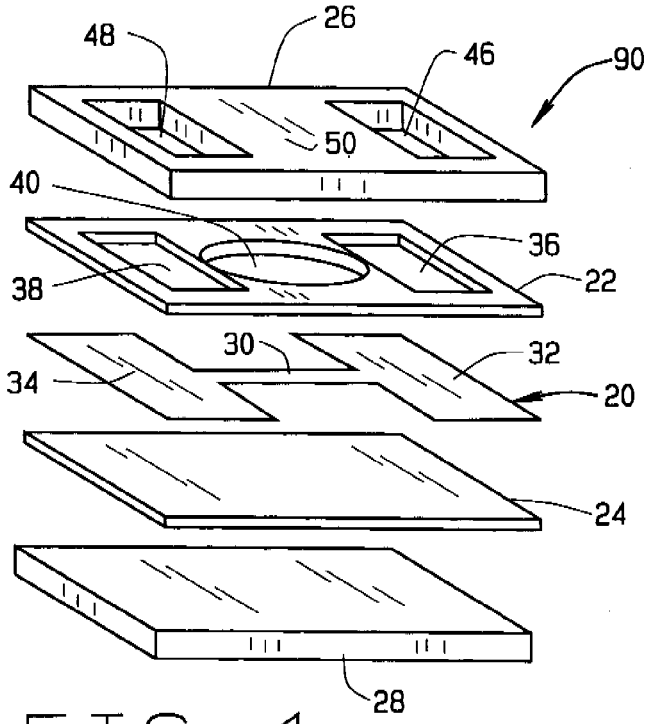
FIG. 4 is an exploded perspective view of a second embodiment of a foil fuse.

FIG. 4 is an exploded perspective view of a second embodiment of a foil fuse 90 substantially similar to fuse 10 (described above in relation to FIGS. 1-3) except for the construction of lower intermediate insulating layer 24. Notably, fusible link opening 42 (shown in FIG. 2) in lower intermediate insulating layer 24 is not present in fuse 90, and fusible link 30 extends directly across the surface of lower intermediate insulation layer 24. This particular construction is satisfactory for fuse operation at intermediate temperatures in that fusible link opening 40 will inhibit or at least reduce heat transfer from fusible link 30 to intermediate insulating layers 22, 24. Resistance of fuse 90 is accordingly reduced during fuse operation, and fusible link opening 40 in upper intermediate insulating layer 40 inhibits arc tracking and facilitates full clearing of the circuit through the fuse.

Fuse 90 is constructed in substantial accordance with method 60 (described above in relation to FIG. 3) except, of course, that fusible link opening 42 (shown in FIG. 2) in lower intermediate insulation layer 24 is not formed.

Figure 5:
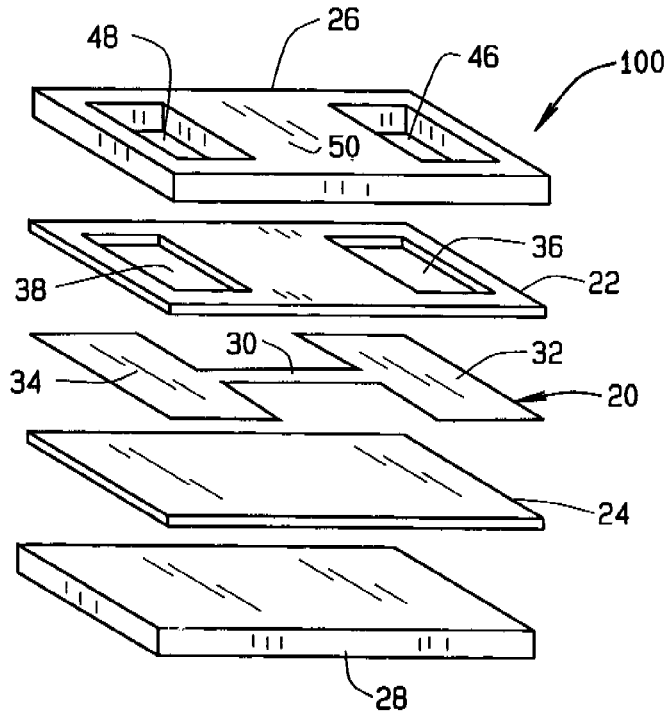
FIG. 5 is an exploded perspective view of a third embodiment of a foil fuse.

FIG. 5 is an exploded perspective view of a third embodiment of a foil fuse 100 substantially similar to fuse 90 (described above in relation to FIG. 4) except for the construction of upper intermediate insulating layer 22. Notably, fusible link opening 40 (shown in FIG. 2) in upper intermediate insulating layer 22 is not present in fuse 100, and fusible link 30 extends directly across the surface of both upper and lower intermediate insulation layers 22, 24.

Fuse 100 is constructed in substantial accordance with method 60 (described above in relation to FIG. 3) except, of course, that fusible link openings 40 and 42 (shown in FIG. 2) in intermediate insulating layers 22, 24 are not formed.

It is appreciated that thin ceramic substrates may be employed in any of the foregoing embodiments in lieu of polymer films, but may be especially advisable with fuse 100 to ensure proper operation of the fuse. For example, low temperature cofireable ceramic materials and the like may be employed in alternative embodiments of the present invention.

Using the above-described etching and die cutting processes on thin metallized foil materials for forming fusible links, a variety of differently shaped metal foil fuse links may be formed to meet particular performance objectives. For example, FIGS. 6-10 illustrate a plurality of fuse element geometries, together with exemplary dimensions, that may be employed in fuse 10 (shown in FIGS. 1 and 2), fuse 90 (shown in FIG. 4) and fuse 100 (shown in FIG. 5). It is recognized, however, that the fuse link geometry described and illustrated herein are for illustrative purposes only and in no way are intended to limit practice of the invention to any particular foil shape or fusible link configuration.

Figure 11:
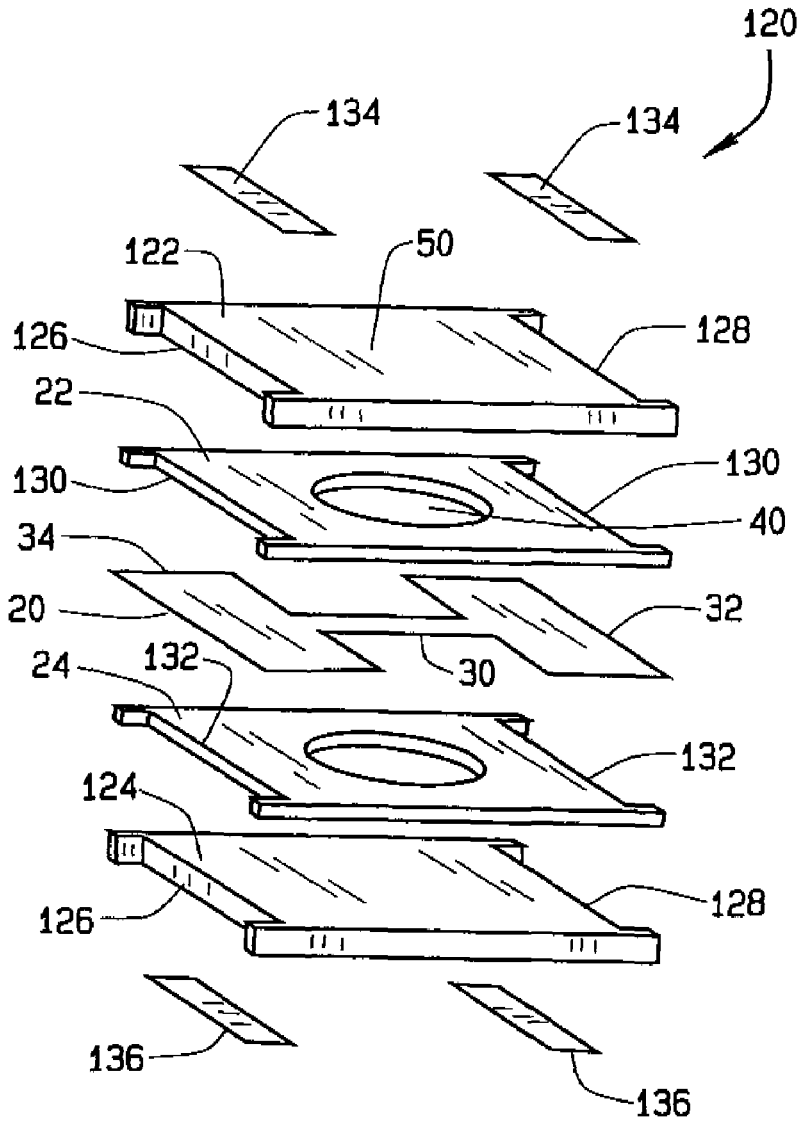
FIG. 11 is an exploded perspective view of a fourth embodiment of a fuse.

FIG. 11 is an exploded perspective view of a fourth embodiment of a fuse 120. Like the fuses described above, fuse 120 provides a low resistance fuse of a layered construction that is illustrated in FIG. 11. Specifically, in an exemplary embodiment, fuse 120 is constructed essentially from five layers including foil fuse element layer 20 sandwiched between upper and lower intermediate insulating layers 22, 24 which, in turn, are sandwiched between upper and lower outer insulation layers 122, 124.

In accord with the foregoing embodiments fuse element 20 is an electro deposited, 3-5 micron thick copper foil applied to lower intermediate layer 24 according to known techniques. Thin fuse element layer 20 is formed in the shape of a capital I with a narrowed fusible link 30 extending between rectangular contact pads 32, 34, and is dimensioned to open when current flowing through fusible link 30 is less than about 7 ampere. It contemplated, however, that various dimensions of the fusible link may be employed and that thin fuse element layer 20 may be formed from various metal foil materials and alloys in lieu of a copper foil.

Upper intermediate insulating layer 22 overlies foil fuse element layer 20 and includes a circular shaped fusible link opening 40 extending therethrough and overlying fusible link 30 of foil fuse element layer 20. In contrast to the fuses 10, 90, and 100 described above, upper intermediate insulating layer 22 in fuse 120 does not include termination openings 36, 38 (shown in FIGS. 2-5) but rather is solid everywhere except for fusible link opening 40.

Lower intermediate insulating layer 24 underlies foil fuse element layer 20 and includes a circular shaped fuse link opening 42 underlying fusible link 30 of foil fuse element layer 20. As such, fusible link 30 extends across respective fuse link openings 40, 42 in upper and lower intermediate insulating layers 22, 24 such that fusible link 30 contacts a surface of neither intermediate insulating layer 22, 24 as fusible link 30 extends between contact pads 32, 34 of foil fuse element 20. In other words, when fuse 10 is fully fabricated, fusible link 30 is effectively suspended in an air pocket by virtue of fuse link openings 40, 42 in respective intermediate insulating layers 22, 24.

As such, fuse link openings 40, 42 prevent heat transfer to intermediate insulating layers 22, 24 that in conventional fuses contributes to increased electrical resistance of the fuse. Fuse 120 therefore operates at a lower resistance than known fuses and consequently is less of a circuit perturbation than known comparable fuses. In addition, and unlike known fuses, the air pocket created by fusible link openings 40, 42 inhibits arc tracking and facilitates complete clearing of the circuit through fusible link 30. Still further, the air pocket provides for venting of gases therein when the fusible link operates and alleviates undesirable gas buildup and pressure internal to the fuse.

As noted above, upper and lower intermediate insulation layers are each fabricated from a dielectric film in an illustrative embodiment, such as a 0.002 inch thick polyimide film commercially available and sold under the mark KAPTON® from E. I. du Pont de Nemours and Company of Wilmington, Del. In alternative embodiments, other suitable electrical insulation materials such as CIRLEX® adhesiveless polyimide lamination materials, Pyrolux, polyethylene naphthalendicarboxylate (sometimes referred to as PEN) Zyvrex liquid crystal polymer material commercially available from Rogers Corporation, and the like may be employed.

Upper outer insulation layer 26 overlies upper intermediate layer 22 and includes a continuous surface 50 extending over upper outer insulating layer 26 and overlying fusible link opening 40 of upper intermediate insulating layer 22, thereby enclosing and adequately insulating fusible link 30. Notably, and as illustrated in FIG. 11, upper outer layer 122 does not include termination openings 46, 48 (shown in FIGS. 2-5).

In a further embodiment, upper outer insulation layer 122 and/or lower outer insulation layer 124 is fabricated from translucent or transparent materials that facilitate visual indication of an opened fuse within fusible link openings 40, 42.

Lower outer insulating layer 124 underlies lower intermediate insulating layer 24 and is solid, i.e., has no openings. The continuous solid surface of lower outer insulating layer 124 therefore adequately insulates fusible link 30 beneath fusible link opening 42 of lower intermediate insulating layer 24.

In an illustrative embodiment, upper and lower outer insulation layers are each fabricated from a dielectric film, such as a 0.005 inch thick polyimide film commercially available and sold under the mark KAPTON® from E. I. du Pont de Nemours and Company of Wilmington, Del. It is appreciated, however, that in alternative embodiments, other suitable electrical insulation materials such as CIRLEX® adhesiveless polyimide lamination materials, Pyrolux, polyethylene naphthalendicarboxylate and the like may be employed.

Unlike the foregoing embodiments of fuses illustrated in FIGS. 2-5 that include solder bump terminations, upper outer insulating layer 122 and lower outer insulating layer 124 each include elongated termination slots 126, 128 formed into each lateral side thereof and extending above and below fuse link contact pads 32, 34. When the layers of the fuse are assembled, slots 126, 128 are metallized on a vertical face thereof to form a contact termination on each lateral end of fuse 120, together with metallized vertical lateral faces 130, 132 of upper intermediate insulating layer and lower intermediate insulating layers 22, 24, and metallized strips 134, 136 extending on the outer surfaces of upper and lower outer insulating layers 122, 124, respectively. Fuse 120 may therefore be surface mounted to a printed circuit board while establishing electrical connection to the fuse element contact pads 32, 34.

For purposes of describing an exemplary manufacturing process employed to fabricate fuse 120, the layers of fuse 120 are referred to according to the following table:

| Process Layer | FIG. 11 Layer | FIG. 11 Reference |
|---|---|---|
| 1 | Upper Outer Insulating Layer | 122 |
| 2 | Upper Intermediate Insulation Layer | 22 |
| 3 | Foil Fuse Element Layer | 20 |
| 4 | Lower Intermediate Insulating Layer | 24 |
| 5 | Lower Outer Insulating Layer | 124 |

Figure 12:
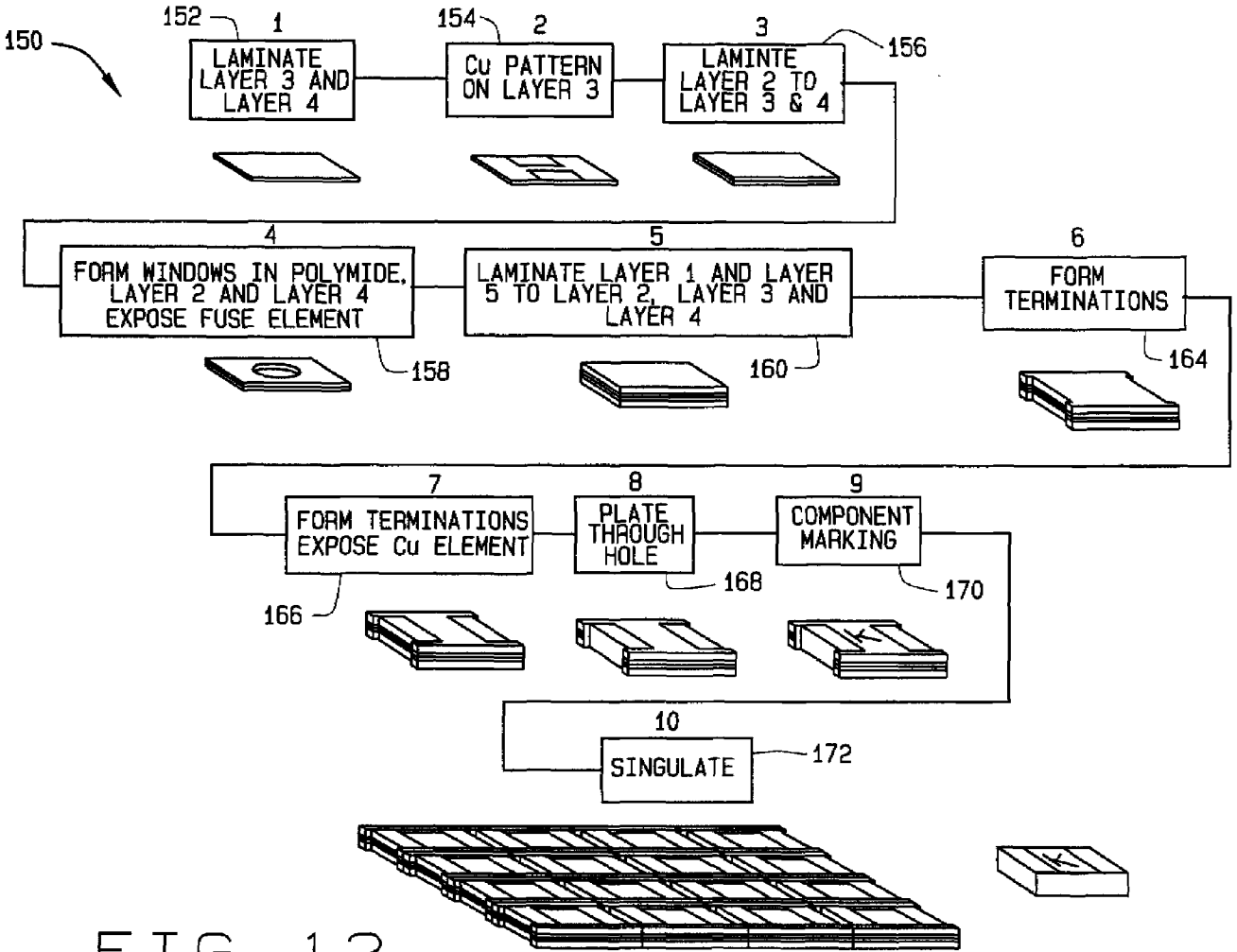
FIG. 12 is process flow chart of a method of manufacturing the fuse shown in FIG. 11.

Using these designations, FIG. 12 is a flow chart of an exemplary method 150 of manufacturing fuse 120 (shown in FIGS. 11). Foil fuse element layer 20 (layer 3) is laminated 152 to lower intermediate layer 24 (layer 4) according to known lamination techniques to form a metallized construction. Foil fuse element layer 20 (layer 3) is then formed 154 into a desired shape upon lower intermediate insulating layer 24 (layer 4) using known techniques, including but not limited to use of a ferric chloride solution etching process. In an exemplary embodiment, foil fuse element layer 20 (layer 3) is formed such that the capital I shaped foil fuse element remains as described above. In alternative embodiments, die cutting operations may be employed in lieu of etching operations to form the fusible link 30 contact pads 32, 34. It is understood that a variety of shapes of fusible elements may be employed in further and/or alternative embodiments of the invention, including but not limited to those illustrated in FIGS. 6-10. It is further contemplated that in further and/or alternative embodiments the fuse element layer may be metallized and formed using a sputtering process, a plating process, a screen printing process, and the like as those in the art will appreciate.

After forming 154 foil fuse element layer (layer 3) from lower intermediate insulating layer (layer 4) has been completed, upper intermediate insulating layer 22 (layer 2) is laminated 156 to pre-laminated foil fuse element layer 20 (layer 3) and lower intermediate insulating layer 24 (layer 4) from step 152, according to known lamination techniques. A three layer lamination is thereby formed with foil fuse element layer 20 (layer 3) sandwiched between intermediate insulating layers 22, 24 (layers 2 and 4).

Fusible link openings 40 (shown in FIG. 11) are then formed 158 in upper intermediate insulating layer 22 (layer 2) and fusible link opening 42 (shown in FIG. 11) is formed 158 in lower intermediate insulating layer 28. Fusible link 30 (shown in FIG. 11) is exposed within fusible link openings 40, 42 of respective intermediate insulating layers 22, 24

(layers 2 and 4). In exemplary embodiments, opening 40 are formed according to known etching, punching, drilling and die cutting operations to form fusible link openings 40 and 42.

After etching 158 the openings into intermediate insulation layers 22, 24 (layers 2 and 4), outer insulating layers 122, 124 (layers 1 and 5) are laminated 160 to the three layer combination (layers 2, 3, and 4) from steps 156 and 158. Outer insulation layers 122, 124 (layers 1 and 5) are laminated 160 to the three layer combination using processes and techniques known in the art.

One form of lamination that may be particularly advantageous for purposes of the present invention employs the use of no-flow polyimide prepreg materials such as those available from Arlon Materials for Electronics of Bear, Delaware. Such materials have expansion characteristics below those of acrylic adhesives which reduces probability of through-hole failures, as well as better endures thermal cycling without delaminating than other lamination bonding agents. It is appreciated, however, that bonding agent requirements may vary depending upon the characteristics of the fuse being manufactured, and therefore that lamination bonding agents that may be unsuitable for one type of fuse or fuse rating may be acceptable for another type of fuse or fuse rating.

Unlike outer insulating layers 26, 28 (shown in FIG. 2), outer insulating layers 122, 124 (shown in FIG. 11) are metallized with a copper foil on an outer surface thereof opposite the intermediate insulating layers. In an illustrative embodiment, this may be achieved with CIRLEX® polyimide technology including a polyimide sheet laminated with a copper foil without adhesives that may compromise proper operation of the fuse. In another exemplary embodiment, this may be achieved with Espanex polyimide sheet materials laminated with a sputtered metal film without adhesives. It is contemplated that other conductive materials and alloys may be employed in lieu of copper foil for this purpose, and further that outer insulating layers 122, 124 may be metallized by other processes and techniques in lieu of CIRLEX® materials in alternative embodiments.

After outer insulation layers 122, 124 (layers 1 and 5) are laminated 160 to form a five layer combination, elongated through holes corresponding to slots 126, 128 are formed 164 through the five layer combination formed in step 160. In various embodiments, slots 126, 128 are laser machined, chemically etched, plasma etched, punched or drilled as they are formed 164. Slot termination strips 134, 136 (shown in FIG. 11) are then formed 166 on the metallized outer surfaces of outer insulation layers 122, 124 through an etching process, and fuse element layer 20 is etched 166 to expose fuse element layer contact pads 32, 34 (shown in FIG. 11) within termination slots 126, 128. After etching 166 the layered combination to form termination strips 134, 136 and etching fuse element layer 20 to expose fuse element layer contact pads 32, 34, the termination slots 126, 128 are metallized 168 according to a plating process to complete the metallized contact terminations in slots 126, 128. In exemplary embodiments, Nickel/Gold, Nickel/Tin, and Nickel/Tin-Lead may be employed in known plating processes to complete terminations in slots 126, 128. As such, fuses 120 may be fabricated that are particularly suited for surface mounting to, for example, a printed circuit board, although in other applications other connection schemes may be used in lieu of surface of mounting.

In an alternative embodiment, castellated contact terminations including cylindrical through-holes may be employed in lieu of the above through-hole metallization in slots 126, 128.

Once the contact terminations in slots 126, 128 are competed, lower outer insulating layer 124 (layer 5) is then marked 170 with indicia pertaining to operating characteristics of fuse 120 (shown in FIG. 120), such as voltage or current ratings, a fuse classification code, etc. Marking 170 may be performed according to known processes, such as, for example, laser marking, chemical etching, or plasma etching.

While fuses 120 could be manufactured singly according to the method thus far described, in an illustrative embodiment, fuses 120 are fabricated collectively in sheet form and then separated or singulated 172 into individual fuses 120. When formed in a batch process, various shapes and dimensions of fusible links 30 (shown in FIG. 11) may be formed at the same time with precision control of etching and die cutting processes. In addition, roll to roll lamination processes may be employed in a continuous fabrication process to manufacture a large number of fuses with minimal time. Further additional fuse element layers and/or insulating layers may be employed to provide fuses of increased fuse ratings and physical size.

Once the manufacture is completed, an electrical connection may be established through fusible link 30 (shown in FIG. 11) when the contact terminations are coupled to line and load electrical connections of an energized circuit.

It is recognized that fuse 120 may be further modified as described above in FIGS. 4 and 5 by elimination of one or both of fusible link openings 40, 42 in intermediate insulation layers 22, 24. The resistance of fuse 120 may accordingly be varied for different applications and different operating temperatures of fuse 120.

In a further embodiment, one or both of outer insulating layers 122, 124 may be fabricated from a translucent material to provide local fuse state indication through the outer insulating layers 122, 124. Thus, when fusible link 30 operates, fuse 120 may be readily identified for replacement, which can be particularly advantageous when a large number of fuses are employed in an electrical system.

According to the above-described methodology, fuses may therefore be efficiently formed using low cost, widely available materials in a batch process using inexpensive known techniques and processes. Photochemical etching processes allow rather precise formation of fusible link 30 and contact pads 32, 34 of thin fuse element layer 20, even for very small fuses, with uniform thickness and conductivity to minimize variation in final performance of fuses 10. Moreover, the use of thin metal foil materials to form fuse element layer 20 renders it possible to construct fuses of very low resistance in relation to known comparable fuses.

While the invention has been described in terms of various specific embodiments, those skilled in the art will recognize that the invention can be practiced with modification within the spirit and scope of the claims.

What is claimed is:

1. A low resistance fuse comprising:

a fuse element layer;

first and second intermediate insulation layers extending on opposite sides of said fuse element layer and coupled thereto, said fuse element layer formed on said first intermediate insulation layer and said second insulation layer laminated to said fuse element layer, wherein said first intermediate insulation layer comprises first and second termination windows therein and;

solder bump terminations located within said termination windows.

2. A low resistance fuse in accordance with claim 1 wherein said fuse element layer comprises a fusible link, at least one of said first and second intermediate layers comprises an opening overlying said fusible link.

3. A low resistance fuse in accordance with claim 2 wherein both of said first and second intermediate insulation layers comprise an opening in the vicinity of said fusible link.

4. A low resistance fuse in accordance with claim 1 wherein said fuse element layer comprises a thin film foil.

5. A low resistance fuse in accordance with claim 4 wherein said fuse element layer has a thickness between about 1 to about 20 microns.

6. A low resistance fuse in accordance with claim 5 wherein said fuse element layer has a thickness between about 3 to about 9 microns.

7. A low resistance fuse in accordance with claim 1 wherein said fuse element layer comprises first and second contact pads and at least one fusible link extending therebetween.

8. A low resistance fuse in accordance with claim 1 further comprising first and second outer insulating layers laminated to respective said first and second intermediate insulating layers.

9. A low resistance fuse in accordance with claim 8 wherein at least one of said first and second outer insulating layers comprises a liquid crystal polymer.

10. A low resistance fuse in accordance with claim 8 wherein at least one of said first and second outer insulating layers comprises a polyimide material.

11. A low resistance fuse comprising:

a thin foil fuse element layer comprising first and second contact pads and a fusible link extending between said first and second contact pads;

first and second intermediate insulation layers extending on and in direct contact with opposite sides of said fuse element layer, at least one of said first and second intermediate insulation layers comprising a substantially cylindrical opening therethrough in the vicinity of said fusible link;

a first outer insulating layer extending over said first intermediate insulation layer;

a second outer insulating layer extending over said second intermediate insulation layer, at least one of said first and second outer insulating layer enclosing said opening of at least one of said first and second intermediate insulation layers; and solder bump terminations extending through said first outer insulating layer and said first intermediate insulation layer in electrical connection with said contact pads of said fuse element layer.

12. A low resistance fuse in accordance with claim 11 wherein at least one of said first and second intermediate insulation layers comprises a polyimide material.

13. A low resistance fuse in accordance with claim 11 wherein at least one of said first and second intermediate insulation layers comprises a liquid crystal polymer.

14. A low resistance fuse in accordance with claim 12 wherein at least one of said first outer insulating layer and said second outer insulating layer comprises a polyimide material.

15. A low resistance fuse in accordance with claim 12 wherein at least one of said first outer insulating layer and said second outer insulating layer comprises a liquid crystal polymer.

16. A low resistance fuse in accordance with claim 11 wherein said thin foil fuse element layer comprises a 1 micron to 20 micron metal foil.

17. A low resistance fuse in accordance with claim 16 wherein said thin foil fuse element layer comprises an electrodeposited 1 micron! to 2b micron metal foil.

18. A low resistance fuse in accordance with claim 17 wherein said thin foil fuse element layer comprises an electrodeposited 3 micron to 12 micron metal foil.

19. A low resistance fuse in accordance with claim 11 wherein said thin foil fuse element layer comprises an electrodeposited copper foil.

* * * * *